US006457282B1

(12) United States Patent
O'Toole

(10) Patent No.: US 6,457,282 B1
(45) Date of Patent: Oct. 1, 2002

(54) RESILIENT SPHERICAL STRUCTURE OF INTERWOVEN RINGS IN TENSILE LOADING

(76) Inventor: Edwin Donald O'Toole, 4019 Park Rd., Hollywood, FL (US) 33021

( * ) Notice: Subject to any disclaimer, the term of this patent is extended or adjusted under 35 U.S.C. 154(b) by 0 days.

(21) Appl. No.: 09/877,994

(22) Filed: Jun. 11, 2001

(51) Int. Cl.[7] ..... E04C 2/42

(52) U.S. Cl. ..... 52/81.2; 52/81.3; 52/660; 52/664; 245/5

(58) Field of Search ..... 52/81.1, 81.2, 52/81.3, 660, 664, 676; 245/5, 2

(56) References Cited

U.S. PATENT DOCUMENTS

| | | | | |
|---|---|---|---|---|
| 485,284 | A | * | 11/1892 | Lehman |
| 837,219 | A | * | 11/1906 | Goldsmith |
| 1,261,259 | A | * | 4/1918 | Meadoff |
| 1,292,188 | A | | 1/1919 | Wheeler |
| 1,880,130 | A | | 9/1932 | Goldbach |
| 2,682,235 | A | | 6/1954 | Fuller |
| 2,881,717 | A | | 4/1959 | Fuller |
| 2,905,113 | A | | 9/1959 | Fuller |
| 2,914,074 | A | | 11/1959 | Fuller |
| 3,063,521 | A | | 11/1962 | Fuller |
| 3,139,957 | A | | 7/1964 | Fuller |
| 3,197,927 | A | | 8/1965 | Fuller |
| 3,203,144 | A | | 8/1965 | Fuller |
| 3,462,521 | A | * | 8/1969 | Bini |
| 3,785,066 | A | | 1/1974 | Tuitt |
| 3,810,336 | A | | 5/1974 | Sadao |
| 3,871,143 | A | | 3/1975 | Quick |
| 4,128,104 | A | * | 12/1978 | Corey |
| 4,277,922 | A | * | 7/1981 | McAllister |
| 4,380,133 | A | | 4/1983 | Arnstein |
| 4,456,258 | A | | 6/1984 | Lodrick |
| 4,907,382 | A | | 3/1990 | Schwam |
| 5,862,521 | A | * | 1/1999 | Van Marwijk et al. |
| 6,027,785 | A | * | 2/2000 | Yoshida |
| 6,253,501 | B1 | * | 7/2001 | Provitola |

* cited by examiner

*Primary Examiner*—Robert Canfield
(74) *Attorney, Agent, or Firm*—Robert J. Van Der Wall

(57) ABSTRACT

A skeletal structure is provided, including a plurality of preferably resiliently flexible rings, each ring passing through and thus being interwoven with immediately adjacent rings, preferably five, so that the rings collectively form a flexible mesh, the flexible mesh being formed into a surface having a double curve substantially defining at least a part of a spherical surface. Each ring is formed from a resiliently flexible linear member having first and second member ends, preferably releasibly interconnected by an overlapping clasp. The spherical surface may be a whole sphere, and may comprise thirty two rings. The spherical surface alternatively may be a hemisphere, which is preferable when the skeletal structure is used as the frame for a building, or the roof of a building such as a domed stadium.

The bending of resiliently flexible linear material around to close on itself places the resulting rings into tensile loading, or in tension. This tension is the first of two major factors that results in the skeletal structure having exceptional strength for its very light weight. Although the rings are interwoven, they normally lack fixed point to point connection. Therefore, they can normally slide relative to each other. This is the second major factor that contributes to the great strength of the inventive skeletal structure, i.e., it normally allows sliding between adjacent rings to compensate for and absorb impact forces at any given point on the surface of the skeletal structure.

20 Claims, 6 Drawing Sheets

RESILIENT SPHERICAL STRUCTURE OF INTERWOVEN RINGS IN TENSILE LOADING

BACKGROUND OF THE INVENTION

1. Field of the Invention

The present invention relates to the field of specialized structures and, more particularly, to a skeletal building structure in spherical or hemispherical form similar to a geodesic dome. It is comprised of resiliently flexible rings that are interwoven. The resulting structure is curved to approximate the shape of a sphere or a hemisphere with each of the rings remaining in tension. The resulting skeletal structure achieves incredibly great strength and yet is extremely lightweight. Further related aspects of the invention are that because the curved surface is comprised solely of interwoven rings normally lacking fixed point to point connection, the entire area circumscribed by the ring is available for openings to the structure, and any one of the rings may be opened at its closure point and readily removed from the skeletal structure.

2. Description of the Prior Art

Ever since man has been building structures, he has chiefly relied on vertical components like posts in combination with horizontal components like beams. The posts achieve their function in compression while beams achieve their function with both tension and compression. That is, when a beam is supported by two posts, the space between the posts tends to sag due to the force of gravity with the result that the top side of the beam is compressed while the lower side is tensioned. This was a severe limiting factor because early materials used for construction were frequently dense materials such as stone, which are strong in compression, but considerably weaker in tension. Furthermore, dense material is inefficient for supporting weight as beams are expected to do. That is, the weight of stone is such that is has very little capacity for supporting anything but itself.

The ineffectiveness of beams made from such material was partially overcome sometime around the time of the Romans by engineers who developed archways that distributed sideways the load at the center of the arch to posts on either side. This had the additional advantage of utilizing a structure in which more space could be disposed between the posts, since the span length of beams made from materials that were weak in tension was necessarily limited, resulting in greatly reduced floor space in such structures.

The difficulty with such arches, particularly when constructed of such dense materials, is a tendency of the arch to collapse outwardly. This problem was overcome with the aqueducts because all the arches were placed end to end and supported each other laterally. In the construction of many of the great cathedrals, outward collapse of arches was prevented by exterior structures known as flying buttresses. When the arch concept is revolved about an axis at its center, a dome results and the problem of the external collapse of the dome was then sometimes solved by surrounding the base of the dome with a large chain. The dome at St. Peter's Basilica in the Vatican employs this technique thereby avoiding the necessity for flying buttresses such as are used at the Notre Dame Cathedral in Paris.

As engineering and building materials improved, such building construction resolved into skeletal structures of wood or steel, simple beams were replaced in many instances by trusses and the skeletal structures were covered by surfaces that acted as a skin and played little or no part in the support of the structure.

In the relatively recent past, structures that rely more on tension than compression have been developed. Consider, for example, a balloon in which the entire surface is in tension and there is no supporting skeleton or framework utilizing members which are in compression. This concept has been employed in the extreme case to temporary structures which are supported almost entirely by air trapped inside, any losses from which are supplied by a blower. Such losses can be minimized by the use of airlocks for ingress and egress.

The concept of using tension as the principal force can also be employed in structure utilizing a framework or skeleton, particularly when the surfaces of those structures are curved in more than one dimension. Since a balloon in its simplest form is geometrically described as a sphere, portions of a sphere referred to as sections can be employed in structures which principally rely on tension forces for support. In modern architecture, certain domed structures rely principally on tension for support, and thereby are employed most commonly where large areas are sought to be enclosed without any central supporting posts. Examples particularly include structures in which athletic activities occur like domed stadiums, in which no internal posts can be utilized.

The use of surfaces in the design of structures that curve in two dimensions leads to other complications, however, since construction materials are not naturally found or easily fabricated into such shapes. Complex mathematical and geometric relationships result from the efforts to employ essentially planar and linear building materials in the construction of curved structures. This is frequently achieved by subdividing a curved surface, a sphere, or a section of a sphere, into a multiplicity of small planar surfaces that fit together into a regular and coherent pattern, which surfaces, when small enough in comparison to the diameter of the structure, approximate a curved surface. To understand how this is achieved, it is important to examine the geometry of various polygons that can be employed as the small planar surfaces to approximate a curved surface.

The simplest regular polygon is an equilateral triangle, since it employs the fewest number of sides that can enclose a surface area in a symmetrical form. Since our objective is to achieve three dimensional structures, it is also important to consider the construction of convex polyhedra utilizing polygons. Four equilateral triangles joined together at their edges form the simplest regular polyhedron, a regular tetrahedron.

The next regular polygon is a square, and six squares joined at their edges form the regular polyhedron known as a cube.

The following regular polygon is a pentagon having five equal length sides and five corners with equal interior angles. If regular pentagons are employed to form a three dimensional regular convex polyhedron, it has been established that twelve regular pentagons joined at all their edges will form a regular polyhedron known as a dodecahedron. It is so named because it has twelve faces all of which are identical regular pentagons.

The next regular polygon is a hexagon. However, the regular hexagon cannot be employed to form three dimensional convex polyhedra because three regular hexagons fitted closely together at one corner of each of them produce a flat surface. This results from the fact that the inside angle at any corner of a hexagon is 120 degrees, which in each of the three interior angles of the hexagons attached at one of their corners results in 360 degrees or a complete circle about the point of the three corners. Of course a flat surface cannot be used to form a convex polyhedron because regardless of how many hexagons are used, the surface remains flat. For the same reason, any regular polygon having more than six sides cannot even been joined together at a common corner, so the pentagon is the polygon with the largest number of sides that can be used to form a regular convex polyhedron if no other polygon is employed.

It is noted generally that the triangle can be used to form two other regular convex polyhedra besides the tetrahedron. Eight equilateral triangles formed together at their edges will form a regular convex polyhedron called a octahedron. One other regular convex polyhedron is possible, and it is a icosahedron. It is comprised of twenty equilateral triangles all joined at their edges. These are the only regular convex polyhedra that can be constructed. For an explanation and more information concerning this fact, reference should be made to Polyhedra A Visual Approach by Anthony Pugh, published by University of California Press Berkeley, copyright 1976.

Returning to the question of the design of structures utilizing curved surfaces, it is next important to consider the pioneering inventive activity of Richard Buckminster Fuller with geodesic domes and spheres. In the analysis of these structures, Fuller utilized a term, referring to the tensional force employed for support, that was a contraction of the two words "tensional" and "integrity" which he referred to as "tensegrity". He has stated that geodesic domes are tensegrity structures and that they accomplish their purpose because they have the properties of hydraulically or pneumatically inflated structures, such as the balloon example described above. Fuller has also defined geodesic line as the shortest surface distance between two points on the outside of a sphere. A great circle when used in reference to a sphere is a line formed on the surface of that sphere by a plane that passes through the sphere's center. An example is the earth's equator. Therefore, spherical great circles are geodesics, and the equator is a great circle geodesic. Further information concerning these definitions is available in Fuller's book Synergetics 2, Macmillan Publishing Co., Inc. New York, copyright 1979, pp.177, et seq.

As noted above, the mathematics of structures built from curved surfaces, and specifically geodesic spheres and domes is very complex. As such it is also completely beyond this background, but information concerning it is available in Geodesic Math and How To Use It, by Hugh Kenner, published by the University of California Press Berkeley, copyright 1976.

Fuller received numerous U.S. patents on structure involving these principles. The first apparently was U.S. Pat. No. 2,682,235 issued Jun. 29, 1954. In the summary of that patent, Fuller points out a comparison between conventional building structures and geodesic ones in terms of weight per square foot of enclosed space. He asserts that in conventional wall and roof designs the structural weight of the building frame is often fifty pounds to the square foot whereas a specific example of the geodesic dome of his invention weighs only 0.78 pounds per square foot of enclosed space or 1.56 percent of conventional construction weight. In the specific example, he asserts the construction of a 49 foot diameter dome that enclosed 20,815 cubic feet of space which structure was made from a frame that weighed only 1,000 pounds and a plastic skin that weighed 140 pounds for a total weight of only 1,140 pounds. Yet the structure is asserted to be able to withstand wind velocities up to 150 miles per hour.

The present invention relates to a building component to be employed in structures that utilize the prior art geodesic dome principles to achieve objectives similar in type to that of the foregoing reference.

Other Fuller references include U.S. Pat. No. 2,881,717, issued Apr. 14, 1959, for a paperboard dome. This reference describes the use of cardboard in place of wood, aluminum, steel and other materials and employs particularized folding techniques to maximize structural strength beginning with a substantially planar material.

Another Fuller reference that preceded the paperboard dome was the plydome, U.S. Pat. No. 2,905,113, patented Sep. 22, 1959. A further such Fuller reference is the catenary (geodesic tent), U.S. Pat. No. 2,914,074, issued Nov. 24, 1959. Other Fuller references are the tensegrity, U.S. Pat. No. 3,063,521, issued Nov. 13, 1962, the aspension (geodesic structures), U.S. Pat No. 3,139,957, issued Jul. 7, 1964, monohex (geodesic structures), U.S. Pat. No. 3,197,927, patented Aug. 3, 1965, and the laminar dome, U.S. Pat. No. 3,203,144, patented Aug. 31, 1965. In the detailed example of use of the present invention described hereinafter, a circular building component will be employed to construct a surface the more nearly approximates a true spherical surface. Another reference is that of Fuller in regard to FIGS. 23 and 24 of the last reference, U.S. Pat. No. 3,203,144.

Another reference is U.S. Pat. No. 3,810,336, for the geodesic hexa-pent by Shoji Sadao, a Fuller associate, which shows the above-described combinations of pentagons and hexagons formed from triangles to create a structure that is a section of what amounts to an icosahedron.

One of the other references located in a pre-examination search is Lodrick, U.S. Pat. No. 4,456,258, dated Jun. 26, 1984, which teaches an icosahedral geodesic sphere gameboard. The same geometry is seen showing a sphere structure formed of twenty hexagons and twelve pentagons formed respectively from six triangles and five triangles to create a three frequency icosahedron.

Another interesting reference is Schwam, U.S. Pat. No. 4,907,382, dated Mar. 13, 1990, showing a structure of a geodesic dome with an assembly and method. The panels are interlocking and an individual panel cannot be removed once assembled. A further reference is Wheeler, U.S. Pat. No. 1,292,188, dated Jan. 21, 1919, which illustrates construction of a dodecahedron, formed from regular pentagons and other polyhedra. Other reference are Arnstein, U.S. Pat. No. 4,380,133, dated Apr. 19, 1983, showing a flat pattern for a dodecahedron, Quick, U.S. Pat. No. 3,871,143, dated Mar. 18, 1975, showing a building element for beach and play structures generally using triangles, Goldbach, U.S. Pat. No. 1,880,130, dated Sep. 27, 1932, showing three dimensional polygon puzzles, and finally Tuitt, U.S. Pat. No. 3,785,066, dated Jan. 15, 1974, for modular paper sculptures.

While the prior art clearly defines and establishes the advantages and use of geodesic structures and teach means of building same from various planar materials, none of the prior art employ the highly particularized shape of resilient interwoven rings to achieve great strength, flexibility (resiliency), interlocking, removability, and flexibility of use of the present invention.

Bearing in mind the foregoing, it is a principal object of the present invention to provide a skeletal structure having a surface with a double curve substantially defining at least a region of a sphere, which is referred to hereinafter as a spherical surface, comprised of resiliently flexible interwoven rings, with each of the rings remaining in tension to achieve great strength with very light weight.

A closely related principal object of the present invention to utilize the foregoing skeletal structure as the framework of hemispherical buildings.

Another related object of the invention to provide a skeletal hemispherical building structure which can be formed from an essentially linear material such as resiliently flexible steel formed into rings that are interwoven with each other.

One more related object of the invention is to construct the skeletal structure using rings formed from a resiliently flexible linear member having first and second member ends, wherein the first and second member ends are preferably releasibly interconnected by an overlapping clasp.

A further object of the invention is that its particularized functions include removability of one or more rings from a spherical surface or any other shaped surface without disassembly of the entire surface.

An additional object of the invention is to provide skeletal support with easy addition, removability and interchangeability of a plurality of functional or decorative surfaces attached to the interior area of the rings. As an example, if a geodesic like full sphere is assembled having a diameter of only a few feet, decorative surfaces can be applied that are mirrors and the sphere then rotated in an environment of bright spotlights to create moving points of light in a darkened room for entertainment purposes. While such devices are well known from a functional standpoint, none are believed to be supported using anything remotely similar to the inventive skeletal structure, which illustrates one of numerous objects and advantages of the invention.

One more object of the invention is enhanced strength of a spherical surface constructed from components in the form of resiliently flexible rings, which enhanced strength results from unique aspects of the inventive skeletal structure. The first two are that the rings are in tension and are interwoven. This interwoven design causes segments of the rings to bear against other rings in a way in which each ring is perpendicular to sphere radial lines and each is pressed inwardly and outwardly in an alternating series of contact points along its circumference by abutment with interwoven rings to place each ring in static equilibrium. The enhanced strength also result from the fact that the resiliently flexible rings normally lack fixed point to point connection, and therefore can slide relative to each other to compensate for and absorb impact forces at any given point on the surface of the skeletal structure, or on the functional and/or decorative surfaces attached to the interior areas of the rings.

SUMMARY OF THE INVENTION

The present invention accomplishes the above-stated objectives, as well as others, as may be determined by a fair reading and interpretation of the entire specification.

A skeletal structure is provided, including a plurality of preferably resiliently flexible rings, usually of substantially equal diameters, each ring passing through and thus being interwoven with several immediately adjacent rings, so that the rings collectively form a flexible mesh, the flexible mesh being formed into a surface having a double curve substantially defining at least a region of a sphere, which is referred to as a spherical surface. The diameter of the rings is selected relative to the diameter of the spherical surface so that the curvature of that spherical surface is sufficient to cause each ring to place each of its interwoven adjacent rings in slight bending contact. In addition, the thickness of the linear members from which the rings are made is selected to make the rings resiliently flexible, yet strong enough to provide skeletal structure support.

Each ring preferably is interwoven with at least five immediately adjacent rings. Each ring is formed from a resiliently flexible linear member having first and second member ends. The first and second member ends are preferably releasibly interconnected by an overlapping clasp. The overlapping clasp preferably includes a first interlocking structure at the first member end. To form the preferred first interlocking structure, a doubled back segment of first member end is curved to an extent that it reverses direction and parallels itself to define a first loop. Then the remainder of the doubled back segment of the first member end is bent into a lateral hook to arch around the adjacent parallel portion of member end to form a snap fastener. See FIG. 4. To form the preferred second interlocking structure, the second member end is bent into a second loop and then spirally wrapped around the portion of second member end adjacent the second loop in the configuration of a noose. The second loop is large enough to receive and pass the entire first interlocking structure when open.

As a first alternative, the first and second member ends may be more permanently interconnected by a weld, in which case the linear member preferably employs butt member ends. As a second alternative, the first and second member ends are held butt to butt with a butt end connector. As a third alternative, the first and second member ends may be threaded male end to female end. Other connection means may be alternatively employed and are within the contemplation of the inventor.

The spherical surface may be a whole sphere, and may comprise thirty two rings. The spherical surface alternatively may be a hemisphere, which is preferable when the skeletal structure is used as the frame for a building, or the roof of a building such as a domed stadium.

A skeletal structure is further provided, including a plurality of preferably resiliently flexible rings of preferably uniform diameter. Each ring passes through and thus is interwoven with several immediately adjacent rings, so that the rings collectively form a flexible mesh. The flexible mesh is formed into a surface having a double curve substantially defining a spherical surface.

The diameter of the rings is selected relative to the diameter of the spherical surface so that the curvature of that spherical surface is sufficient to cause each ring to place each of its interwoven adjacent rings in slight bending contact. In addition, the thickness of the linear members from which the rings are made is selected to make the rings resiliently flexible, yet strong enough to provide skeletal structure support.

The spherical structure is primarily contemplated for the numerous practical applications described in this specification elsewhere, but it is within the contemplation of the inventor that the same structure could be assembled in space as an earth motor with very large diameter rings around the earth to intercept the earth's electromagnetic fields, generating and collecting energy thereby.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
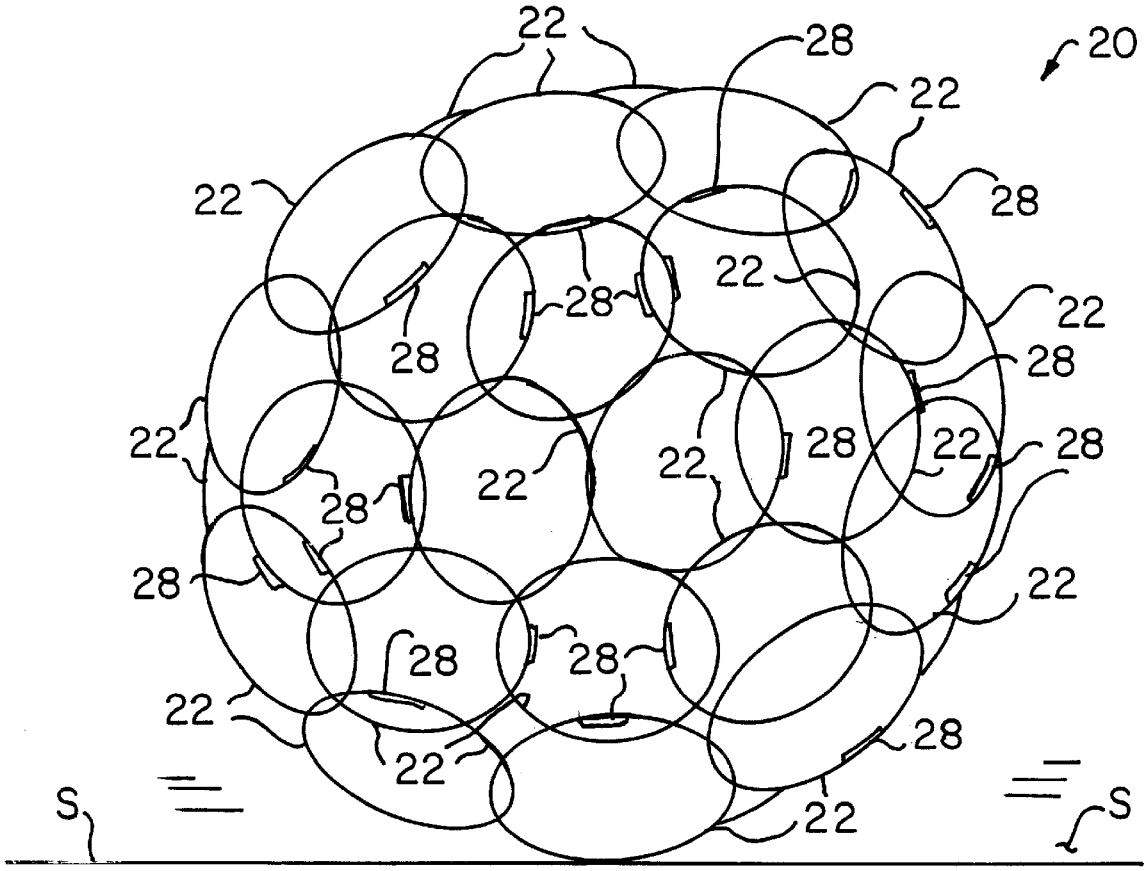
FIG. 1 is a perspective view of the skeletal structure assembled to form a whole sphere shape.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

Figure 5:
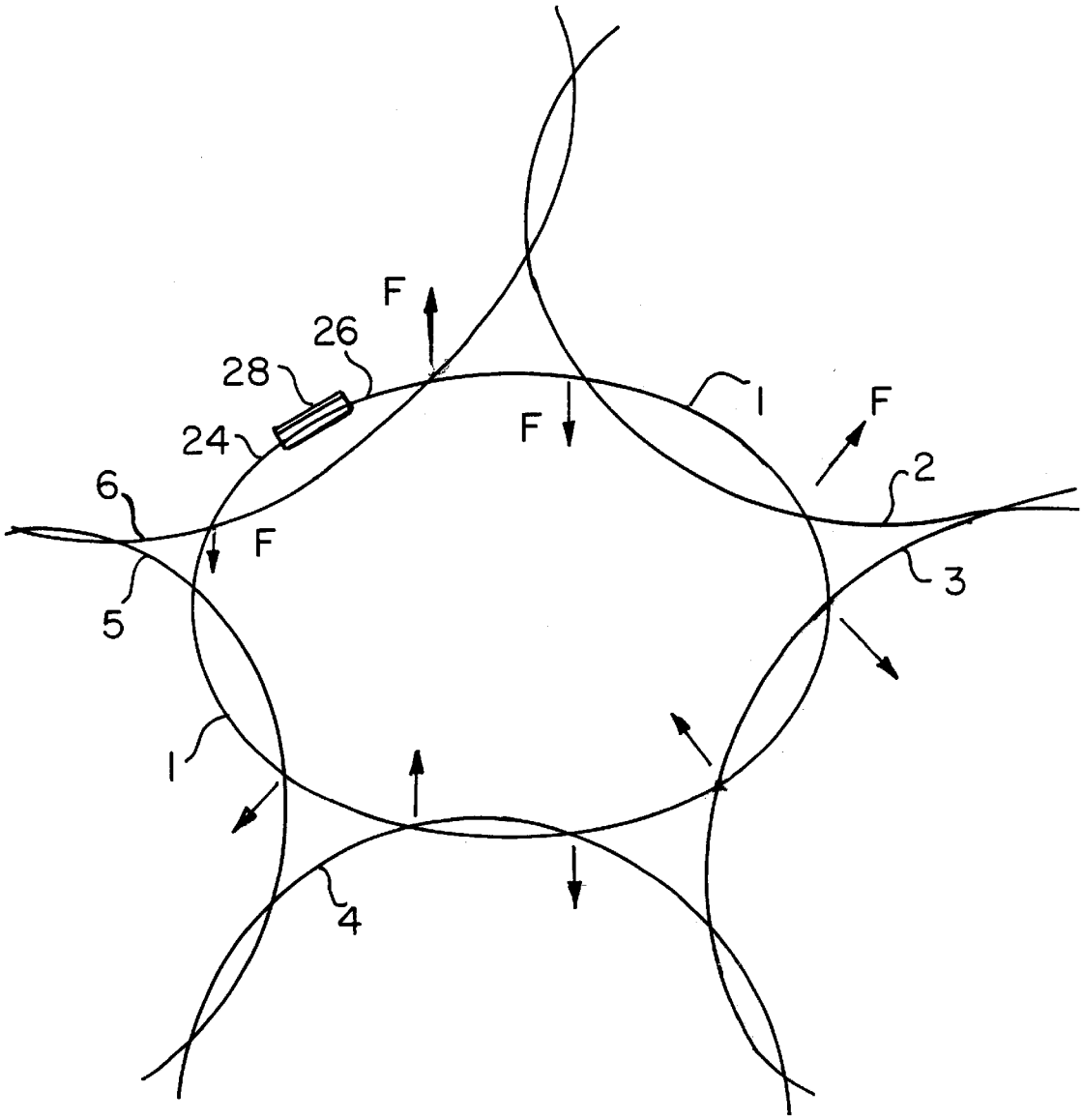
FIG. 5 is also an enlarged view showing partial views of five adjacent rings interwoven to a given reference ring at the center of FIG. 2 and illustrating with arrows abutment forces bringing the reference ring into static equilibrium.
Figure 6:
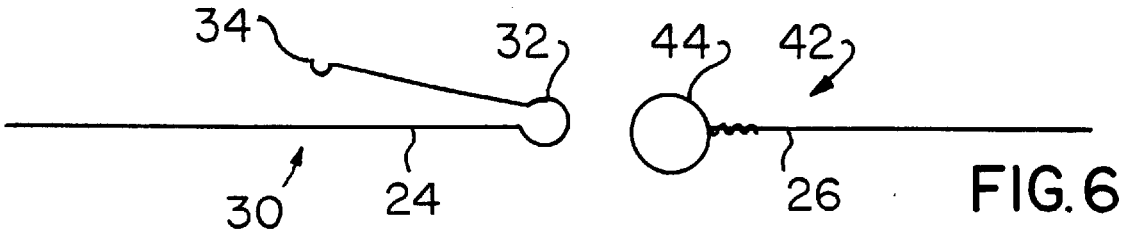
FIG. 6 is a broken away view of the two member ends of a ring, these member ends being bent into the configuration of the preferred engaging structure to define first and second interlocking structures, respectively.
Figure 7:
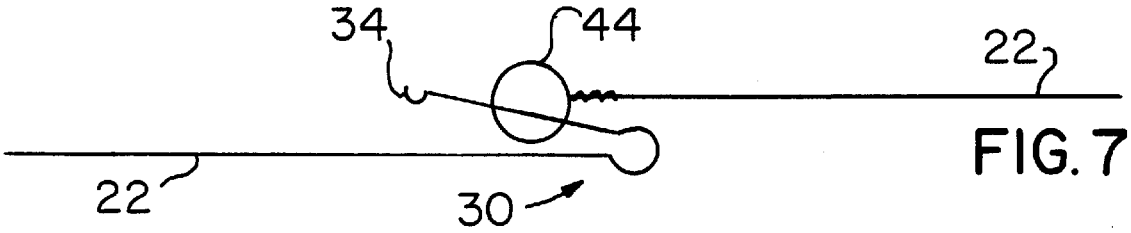
FIG. 7 is a view as in FIG. 6 with the first interlocking structure having a first loop, partially fitted through the second loop of the second interlocking structure.
Figure 8:
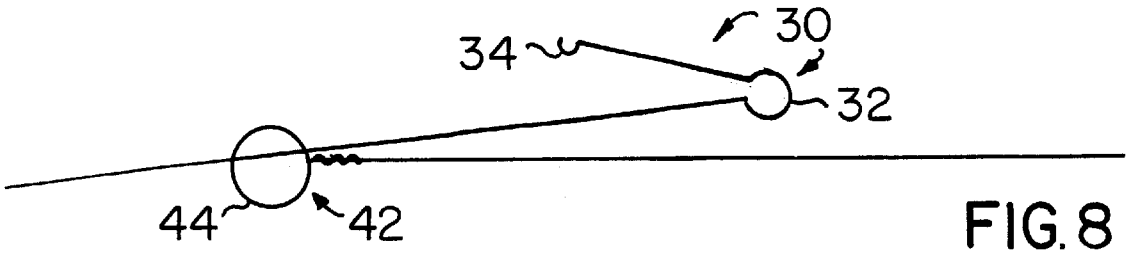
FIG. 8 is a view as in FIG. 7 with the first interlocking structure, completely fitted through the second loop of the second interlocking structure.

Referring to FIGS. 1–14, a skeletal structure 20 defining a spherical surface that may be a sphere or hemisphere is disclosed, the skeletal structure 20 being constructed of a plurality of interwoven rings 22. See FIG. 1. Interwoven means that each ring 22 passes through at least two, and preferably five or six, adjacent rings 22. See FIGS. 2 and 5.

Figure 2:
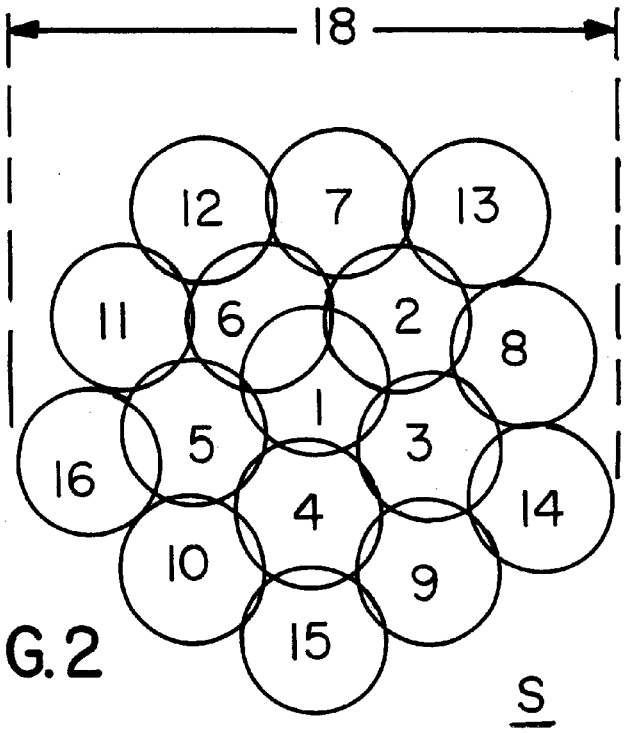
FIG. 2 is a top plan view of 16 sequentially numbered interwoven rings lying flat on surface S with a given diameter, and making a mesh that forms the skeletal structure.
Figure 12:
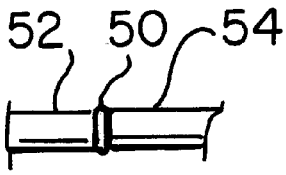
FIG. 12 is an enlarged fragmentary view showing first and second butt ends joined by a conventional weld.
Figure 13:
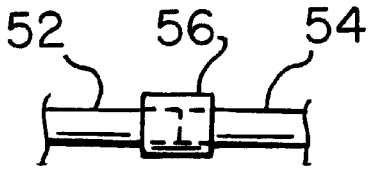
FIG. 13 is an enlarged fragmentary view showing in phantom first and second member ends held with a butt end connector.
Figure 3:
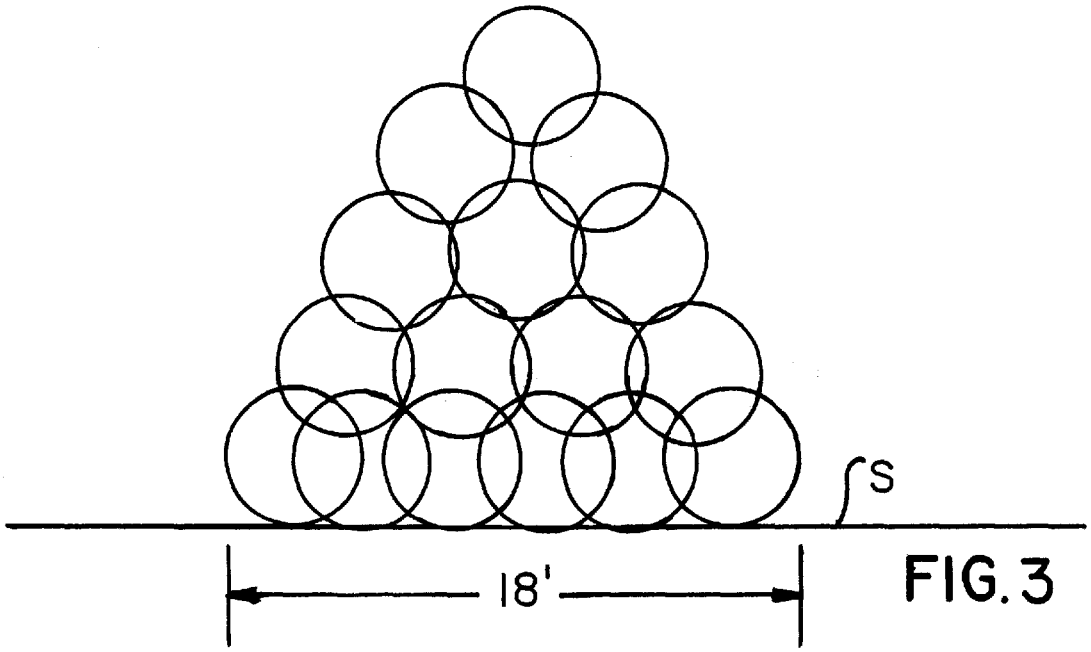
FIG. 3 is a side elevation view of the mesh of FIG. 2, but showing the result of reducing the diameter of FIG. 2.
Figure 14:
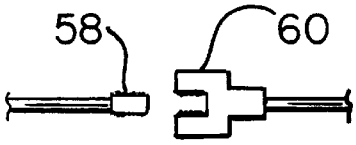
FIG. 14 is an enlarged fragmentary partially cross sectional view showing a male and female threaded end connector.
Figure 4:
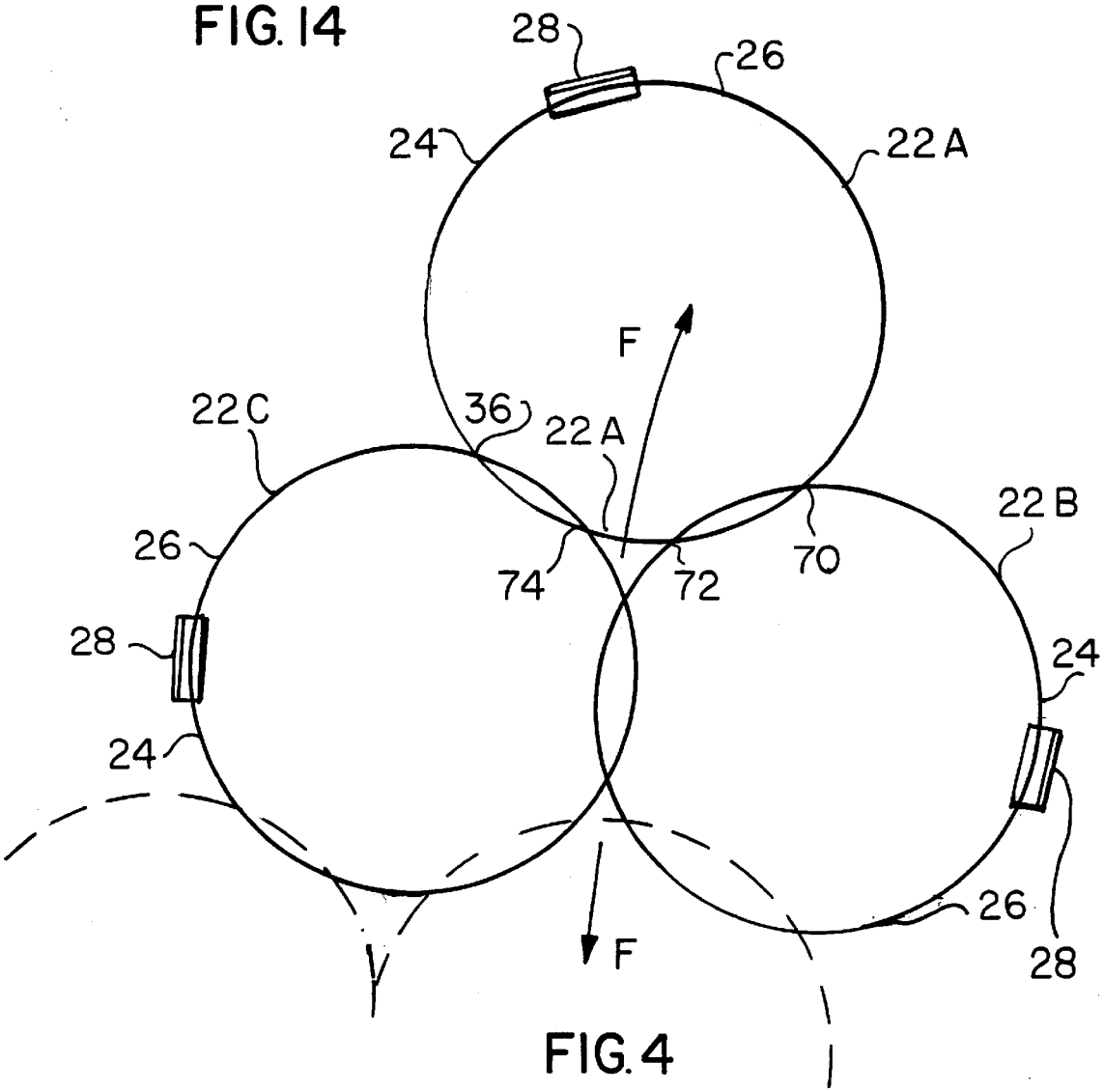
FIG. 4 is an enlarged view showing three adjacent rings and illustrating how the rings are interwoven.

In FIG. 2, the assembly rotation is shown with sixteen rings numbered sequentially. It should be noted that ring 1 is at the center, and is surrounded by rings 2 through 6. Then each adjoining pairs of rings 2 through 6 are each interwoven with a ring, these being ring 7 for rings 2 and 6, ring 8 for rings 2 and 3, ring 9 for rings 3 and 4, ring 10 for rings 4 and 5, and ring 10 for rings 5 and 6. Then rings 12 through 16 are interspersed between rings 7 and 8, 8 and 9, 9 and 10, and 10 and 11 respectively. At this point the resulting mesh will lay substantially flat on a supporting surface S as seen in FIG. 2. But, if the diameter 18 of outer circumference is compressed to a smaller diameter 18' as shown in FIG. 3, the sixteen rings of FIG. 2 will form a hemisphere. Diameter 18' is typically approximately two thirds of diameter 18. Obviously, an additional 16 rings similarly assembled form another hemisphere, and the two combined form a sphere of 32 rings. The mesh of FIG. 2 will not lie flat if any more than sixteen rings is added.

Each ring 22 is formed from a resiliently flexible linear member having first and second member ends 24 and 26 which preferably are releasibly interconnected by an overlapping clasp 28, such that the ring 22 can be opened for interweaving to other rings 22 during skeletal structure 20 construction, and then reconnected to function as a closed ring. See FIG. 4.

The bending of the resiliently flexible linear member around to close on itself places the resulting ring 22 into tensile loading, or in tension. This tension is one of the two major factors that results in the skeletal structure having exceptional strength for its very light weight. Skeletal structure 20 may function to support and shape an outer skin layer (not shown) to create an enclosure, such as a building or its roof, wherein it functions as the frame of the building or roof.

Rings 22 preferably are each interwoven with five or six other rings 22 generally uniformly spread about its circumference. See FIG. 5, which is an enlargement of the center portion of FIG. 2. This is accomplished by interweaving ring 22 over and under succeeding adjacent rings 22 which causes slight flexure of ring 22 as all of the rings collectively form a flexible mesh that may be flat, but is preferably assembled along a double curve about three perpendicular axes to define a spherical surface, a hemisphere, or a complete sphere. For purposes of discussion of flexure that results from the interwoven structure, a cluster of rings 22 are referred to below including an arbitrarily selected reference ring **22*a* and immediately adjacent rings 22*b* and 22*c* directly interwoven with ring 22*a*. See FIG. 4**.

Any given reference ring **22*a* contacts each adjacent ring 22*b* and 22*c* at two points. One point 70 of such abutment is that where a given adjacent ring 22*b* passes behind the reference ring 22*a* and presses the reference ring 22*a* outwardly from the sphere interior, and the second point 72 of abutment is that where the given adjacent ring 22*b* passes in front of the reference ring 22*a* and presses the reference ring 22*a* inwardly toward the interior of the sphere. Then traveling about the circumference of 22*a* clockwise, 22*a* contacts 22*c* in two places also. The first point 74 of such abutment is where ring 22*c* passes behind the reference ring 22*a* and presses the reference ring 22*a* outwardly from the sphere interior, and the second point 76 of abutment is that where the given adjacent ring 22*c* passes in front of the reference ring 22*a* and presses the reference ring 22*a* inwardly toward the interior of the sphere. These opposing forces at the two contact points for each adjacent ring produce a resultant torque within each of the reference ring 22*a* and adjacent rings 22*a* and thereby place each of the reference and adjacent ring 22*a* and 22*b* in slight flexure that results from the contact of each ring 22 with each of its adjacent rings 22*a*, 22*b*, 22*c*, etc. That is, multiple adjacent rings 22*b*, 22*c*, etc. are interwoven to given reference ring 22*a*, a circumferential series of alternatingly opposing forces act on the reference ring 22***a* creating a multiplicity of torques on reference ring 22*a,* placing the reference ring 22*a* in static equilibrium. The direction of each abutment force F is angled relative to the plane of the given reference ring 22*a,* such that these opposing forces F have components perpendicular to the plane of the reference ring 22*a* which counterbalance and create equilibrium and have components substantially within the plane of the reference ring 22*a* which also counterbalance and create equilibrium. See FIG. 5. But at the same time, it should be noted that although the rings are interwoven, they normally lack fixed point to point connection. Therefore, they can normally slide relative to each other. This is the second major factor that contributes to the great strength of the inventive skeletal structure, i.e., it normally allows sliding between adjacent rings to compensate for and absorb impact forces at any given point on the surface of the skeletal structure, or on the functional and/or decorative surfaces attached to the interior areas of the rings.

Although adjoining rings normally lack point to point connection, it is sometimes desirable to lock the rings one to another at their contact points. Doing so results in a much more rigid structure, which may be important when using the spherical structure as a roof of a domed building where things will be attached to the interior of the roof, thus requiring greater stability. Locking the rings to each other can be accomplished with conventional means, such with welding, wire, clamps, etc.

The strength, flexibility and resilience of rings 22 are preferably uniform and are selected such that only slight ring 22 deformation occurs when the skeletal structure 20 sphere rests on a support surface S, and the resistance of the rings 22 to further bending reaches equilibrium with the weight of skeletal structure 20 and any skin on structure 20. In other words these parameters are selected such that, when resting on a support surface S, skeletal structure 20 deforms only slightly in shape before becoming stable and self-supporting. Rings 22 alternatively may be substantially inflexible or nearly rigid.

The diameter of the individual rings 22 relative to the skeletal structure 20 sphere diameter, and thus the number of rings 22 making up skeletal structure 20, is selected such that the sphere curvature is just sufficient to cause each ring 22 to place each of its interwoven adjacent rings 22 in only slight bending tension during structure 20 self support. For constructing a skeletal structure 20 in the form of a sphere, a preferred number of rings 22 is thirty-two forming a platonic solid, although many other numbers are contemplated. It is also noted that each ring 22 is substantially planar and produces a substantially planar facet of the resulting skeletal structure 20. Therefore, the greater the number of rings 22 making up skeletal structure 20, the closer structure 20 approximates the smooth curvature of a pure sphere surface. Rings 22 preferably are all of uniform diameter, although it is alternatively contemplated that two or more different ring 22 diameters may be found in a given skeletal structure 20. The overall size of skeletal structure 20 may be so large that structure 20 functions as a building or a part of a building, such as a dome over a stadium, or so small as to function as a faceted mirror ball for reflecting and scattering light at a dance hall or skating rink.

The means of closure of each ring may take any of several forms. The preferred embodiment is an overlapping clasp 28, shown fully assembled in FIG. 11. Overlapping clasp 28 preferably is created by bending the ring 22 at first and second member ends 24 and 26 to create first and second interlocking structures 30 and 42 which not only prevent end 24 and 26 separation in axial and torsion loading, but also provide resistance to bending consistent and uniform with other segments of the ring 22 circumference. As a result, the shape of ring 22 during bending at any point along its circumference is substantially the same as it would be if ring 22 was endless. This structural characteristic is achieved by providing significant first member end 24 and second member end 26 overlap and lateral interconnection at each end of the overlap.

To form the preferred first interlocking structure 30, a doubled back segment of first member end 24 is curved to an extent that it reverses direction and parallels itself to define a first loop 32. Then the remainder of the doubled back segment of first member end 24 is bent into a lateral hook 34. See FIG. 6. Lateral hook 34 later arches around the adjacent parallel portion of member end 24 to form a snap fastener 36. See FIG. 10. To form the preferred second interlocking structure 42, the second member end 26 is bent into a second loop 44 and then spirally wrapped around the portion of second member end 26 adjacent the second loop 44 in the configuration of a noose. Second loop 44 is large enough to receive and pass the entire first interlocking structure 30 when open.

Figure 9:
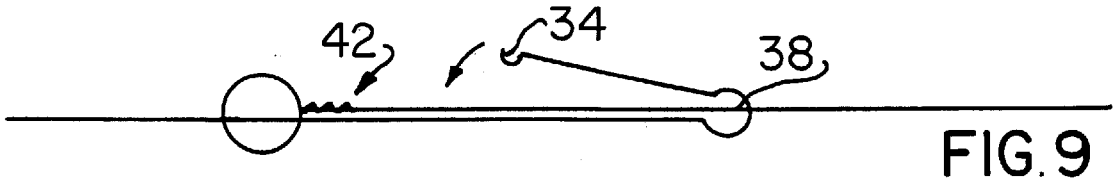
FIG. 9 shows placement of wire near the second loop through the first loop.
Figure 10:
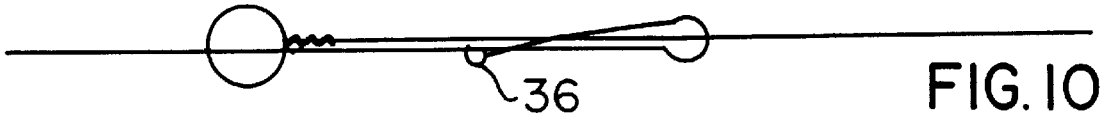
FIG. 10 shows the closure of the snap fastener formed by the lateral hook of first interlocking structure being placed around the adjacent parallel portion of the first interlocking structure.
Figure 11:
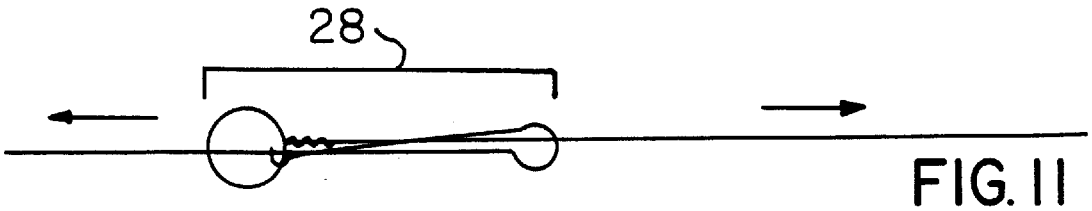
FIG. 11 is a view with the second loop of the second interlocking structure pulled into abutment with the lateral hook of the first interlocking structure, thereby maintaining the overlap of the member ends.

To interconnect first and second interlocking structures 30 and 42 to complete the circle of a given ring 22, the entire first interlocking structure 30 is passed through the second loop 44 of the second interlocking structure 42. See FIGS. 7 and 8. Snap fastener 36 must be open as seen in FIG. 9 so that wire 38 near second interlocking structure 42 and second loop 44 can be passed through first loop 32. Then lateral hook 34 is placed around the adjacent parallel portion of member end 24 to form the snap fastener 36. See FIG. 10. The snap fastener 36 is closed so that wire from each end of ring 22 passes through the loop of the opposite end. Then the first and second loops 32 and 44 are slid toward each by pulling outwardly on ring 22 to retain the extent of the overlap of member ends 24 and 26 so that during linear member bending there is uniform bending of the ring 22 wire rather than pivoting at overlapping clasp 28. See FIG. 11.

As a first alternative, the first and second member ends 24 and 26 may be more permanently interconnected by a conventional weld 50 such as may be desirable when the inventive skeletal structure is being used to construct the frame of a permanent building, and each of the adjacent rings must be interwoven before welding on that ring is performed. In that event, the linear member bent into ring 22 preferably employs butt member ends 52 and 54, which means they are cut off at right angles to a centerline thereof. See FIG. 12.

As a second alternative, the first and second member ends are held butt end 52 to butt end 54 with a removable butt end connector 56. See FIG. 13. Butt end connector is in the form of a cylindrical collar that is engaged in a tight, but preferably removable, fit with butt ends 52 and 54 and is crimped to hold the butt ends 52, 54 in the butt end connector 56. See FIG. 13.

As a third alternative, the first and second member ends 24 and 26 may be threaded male end 58 to female end 60. See FIG. 14.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A skeletal structure comprising:

a flexible mesh formed from a plurality of resiliently flexible rings in tensile loading interwoven but lacking fixed point to point connection, in which each ring is interwoven with at least five immediately adjacent rings, except for those at the mesh edge, for static equilibrium.

2. The skeletal structure of claim 1 in which the structure is shaped as a spherical surface.

3. The skeletal structure of claim 2 in which the spherical surface is a frame of a building.

4. The skeletal structure of claim 2 in which the spherical surface is a frame of a roof of a building.

5. The skeletal structure of claim 1 in which the interwoven rings form a sphere.

6. The skeletal structure of claim 1 in which the interwoven rings form a hemisphere.

7. The skeletal structure of claim 1 in which resiliently flexible rings are formed of a resiliently flexible linear member having first and second member ends.

8. The skeletal structure of claim 7 in which the first and second member ends are preferably releasibly interconnected,by an overlapping clasp.

9. The skeletal structure of claim 8 in which the first member end and second member end include a first and a second interlocking structure.

10. The skeletal structure of claim 9 in which the first interlocking structure comprises the first member end being doubled back parallel to itself to create a first loop and a lateral hook for removable placement around the first member end adjacent to first loop.

11. The skeletal structure of claim 9 in which the second interlocking structure comprises the second member end shaped into a second loop.

12. The skeletal structure of claim 9 in which the first member end is disposed in the second loop and the second member end is disposed in the first loop.

13. The skeletal structure of claim 10 in which the second member end is disposed in the first loop and the lateral hook is removably disposed around the first member end adjacent to the first loop.

14. The skeletal structure of claim 7 in which the first and second member ends are joined by welding after the rings have been interwoven.

15. The skeletal structure of claim 7 in which the first and second member ends are joined by a butt end connector.

16. The skeletal structure of claim 7 in which the first and second member ends are joined by male and female threaded connectors.

17. The skeletal structure of claim 1 in which each of the rings remains in tension to achieve great strength with very light weight.

18. The skeletal structure of claim 2 in which interweaving the rings causes segments of the rings to bear against other rings in a way in which each ring is perpendicular to spherical surface radial lines and each is pressed inwardly and outwardly in an alternating series of contact points along its circumference by abutment with interwoven rings to place each ring in static equilibrium.

19. The skeletal structure of claim 1 wherein the absence of fixed point to point connection between rings allows sliding relative to each other to compensate for and absorb impact forces at any given point on the skeletal structure.

20. A skeletal structure comprising:

a mesh formed of a plurality of resiliently flexible rings in tensile loading initially interwoven without fixed point to point connection, in which each ring is interwoven with at least five immediately adjacent rings, except for those at the mesh edge, and then with each ring attached to each other at each contact point upon achieving static equilibrium to form a substantially rigid mesh shaped as a spherical surface that serves as at least a part of a frame of a building.

* * * * *